US007360913B2

(12) United States Patent
Currie

(10) Patent No.: US 7,360,913 B2
(45) Date of Patent: Apr. 22, 2008

(54) PORTABLE ILLUMINATION APPARATUS FOR A FLUID DISPENSER

(76) Inventor: Joseph Edward Currie, 506 White Plains Rd., Webster, NH (US) 03303-7112

( * ) Notice: Subject to any disclaimer, the term of this patent is extended or adjusted under 35 U.S.C. 154(b) by 242 days.

(21) Appl. No.: 10/967,884

(22) Filed: Oct. 18, 2004

(65) Prior Publication Data

US 2005/0094398 A1 May 5, 2005

Related U.S. Application Data

(60) Provisional application No. 60/514,976, filed on Oct. 29, 2003.

(51) Int. Cl.
*F21V 33/00* (2006.01)

(52) U.S. Cl. ..... 362/101; 362/96; 362/806

(58) Field of Classification Search ..... 362/96, 362/101; 137/560, 801
See application file for complete search history.

(56) References Cited

U.S. PATENT DOCUMENTS 5,491,617 A 2/1996 Currie
6,953,256 B2 * 10/2005 Turner ..... 362/96
2005/0276035 A1 * 12/2005 Currie ..... 362/96

FOREIGN PATENT DOCUMENTS

GB 2388586 A * 11/2003

* cited by examiner

*Primary Examiner*—Anabel M Ton

(57) ABSTRACT

Disclosed is an improved four part portable illumination apparatus for a comestible fluid dispenser comprised of a unique portable illumination device that is attached to the bottom side of a liquid dispenser or tap, immediately behind the liquid spout of the tap, and in position to direct colored light in the direction of an ultra-violet light sensitive comestible fluid container, and or container holder, and an ultra-violet light sensitive backsplash or curtain, and an ultra-violet sensitive drip tray. Colored visible illumination and UVa light from a single super bright light emitting diode within the portable illumination device is input into a collimating lens and directed toward a UVa sensitive fluid receptacle and drip tray. Electrical power for the solid-state illumination source is obtained from either a voltage source located within a carbonated fluid dispenser, or from a dedicated low voltage dc power supply.

1 Claim, 2 Drawing Sheets

PORTABLE ILLUMINATION APPARATUS FOR A FLUID DISPENSER

CROSS REFERENCE TO RELATED APPLICATIONS

Please refer to Provisional Application Ser. No. 60/514,976, filing date Oct. 29, 2003.

STATEMENT REGARDING FEDERALLY SPONSORED RESEARCH OR DEVELOPMENT

Not Applicable

FIELD OF THE INVENTION

The present invention relates to portable illumination devices that attach to comestible fluid taps or dispensers.

BACKGROUND OF INVENTION

This invention relates to comestible fluid taps and more particularly to comestible fluid taps with integrated illumination means.

U.S. Pat. No. 5,491,617 issued to Joseph E. Currie on Aug. 4, 1996 discloses an illumination device designed primarily for attachment to a tap dispensing comestible fluids. The illumination device utilizes a separate illuminator that is comprised of a power supply and an illumination source or sources. A first and second light conduit of fiber optic cable is used to transmit light from the illuminator to the tap handle and to the tap spout. The light source in the illuminator is switched on and off by means of a provided electromechanical tilt switch, and the device incorporates a delay circuit that eliminates false switching of the halogen lamp light source or sources in the illuminator.

The above-cited patent does not describe the arrangement of features as disclosed in this new invention.

The present instant invention uses new technology and new ideas to create a new illumination device and system for use on a comestible fluid tap, or fluid dispenser, that creates a visual pleasing experience for a viewer of a dispensed liquid.

SUMMARY OF THE INVENTION

The present invention describes an improved four element portable fluid dispensing illumination apparatus accessory to a comestible fluid dispenser or tap. The object of the present invention is to provide an attractive display of light to the dispensing of comestible fluids. The embodiment of the invention is comprised of a combination of four elements. The four elements of the combination are first a solid state illumination source such as a super bright solid-state colored light and UVa emitting diode or (LED), mounted in a portable unit with a one piece collimation lens, affixed to, and in close proximity to, a comestible fluid dispensing spout. Second of the four elements is a colored plastic background or splashboard, preferably the color of the LED illumination, and preferably made of plastic that glows when exposed to ultraviolet or black light. The third element of the combination is a liquid container, and or container holder, made of any material or plastic, preferably the color of the LED light used with the particular dispenser, and that fluoresces under ultraviolet light, and the fourth item is a ultra-violet sensitive drip tray. These four elements in combination will illuminate the dispensing of a comestible fluid with a very bright and pleasing effect.

In the embodiment of the present invention the first element is comprised of a super bright solid-state light emitting diode emitting visible colored light and UVa light through a collimation lens affixed behind the spout of a comestible fluid dispenser or tap, with a top cap designed to secure the illumination device to the underside of and behind the fluid spout. Certain comestible fluid dispensers are equipped with pressure switches against which the receptacle or drink cup is pushed to activate liquid flow. This switch connects direct current from an internal electrical power supply to activate a flow control valve causing pressurized liquid to fill a receptacle. The dc voltage connected to the flow control valve is connected through a voltage-dropping resistor to power the LED in the present invention so that the LED illuminates only when liquid is flowing. Other comestible fluid taps require a handle to manually operate the fluid control valve to dispense liquids. The LED in the portable illumination device attached to this type of tap will be connected directly to a dedicated low voltage dc voltage source and illuminate continuously.

A second element of the present invention is a colored background, splashboard, or backdrop, behind the area where the comestible fluid is being dispensed, made of a colored plastic that fluoresces or glows when subjected to ultraviolet or black light. The UVa sensitive plastic background will illuminate when the LED of the portable device illuminates, as super bright LEDs are a source of UVa light.

There are other ultraviolet fight sources present in most establishments where comestible fluids are sold that will partially illuminate the UVa sensitive plastic. Two such UVa light sources are direct and reflected sunlight and fluorescent lighting.

A third element of the present invention is a drink container or cup that will enhance the illuminating scheme. The cup may be made of colored material that matches the colored light from the present invention, or may be made of UVa sensitive colored plastic, or may be held by a cup holder made of colored material or colored UVa sensitive plastic.

A fourth element of the present invention is a UVa sensitive drip tray located under the liquid dispenser or tap spout.

DETAILED DESCRIPTION OF THE EMBODIMENT OF THE INVENTION

Figure 1:
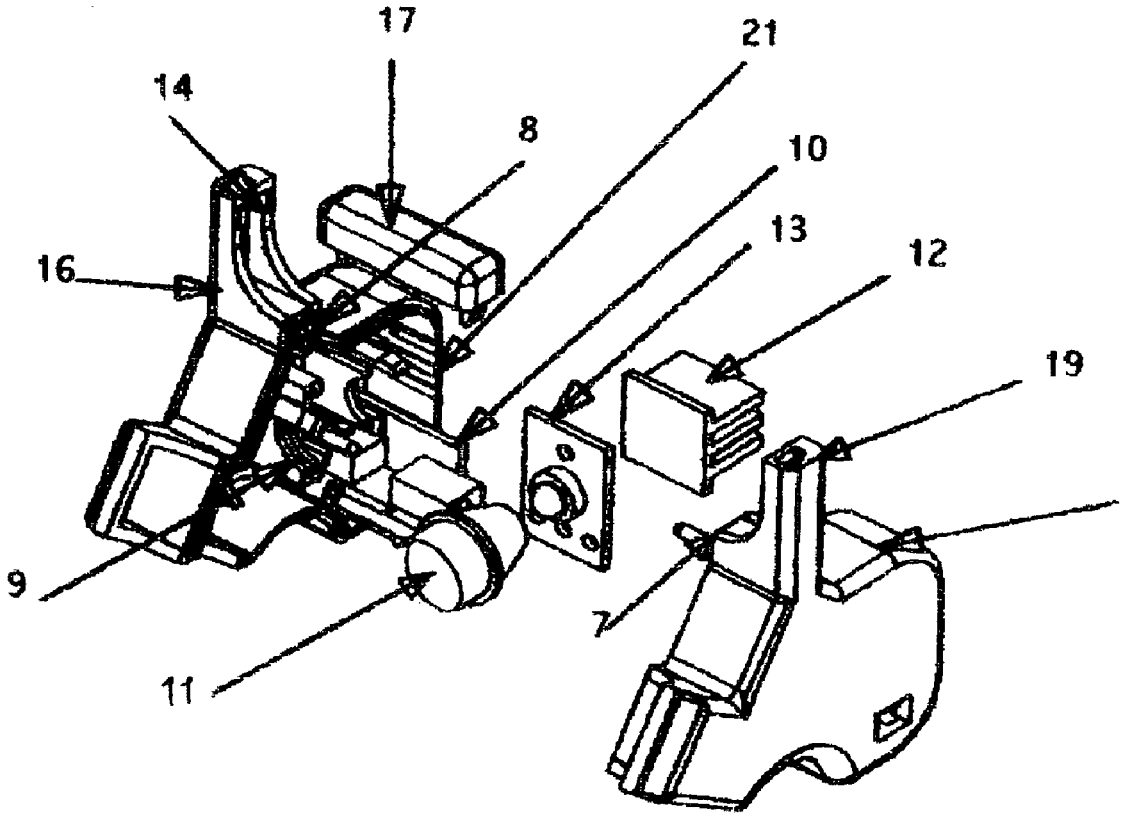
FIG. 1 is a three dimensional exploded view of the first element of the four element illumination appartus.

Referring now to the drawings, the present invention relates to a portable apparatus providing for illumination proximate a fluid tap outlet that illuminates an ultra-violet light sensitive backsplash area, an ultraviolet sensitive fluid receptacle or receptacle holder, and a UVa sensitive drip tray. FIG. 1 discloses a three dimensional exploded view of the first element of the illumination device. A first half of the injection molded plastic case 16 with the necessary internal structural supports 9 that support board mounted light emitting diode LED 13, LED mounting base 10, metal heat sink 12, and collimation lens 11 in place is depicted here. Board mounted light emitting diode LED 13 is affixed to heat sink 12 and inserted into cavity 21 of device first half 16. Collimation lens 11 is installed in cavity 21 of first half plastic case 16 in close proximity to LED 13. The second half 15 of the plastic injection molded case is installed onto the first half 16 by snap fit retention securing the bottom edge surface 8 of first half mounting collar 14 against the bottom edge surface 7 of the second half mounting collar 19 and holding LED 13, base 10, heat sink 12, and collimation lens 11 securely in place. Illumination from LED 13 is directed downward through collimation lens 11. Bridge cap 17 connects and secures both first half mounting collar 14 and second half mounting collar 19 together.

Figure 2:
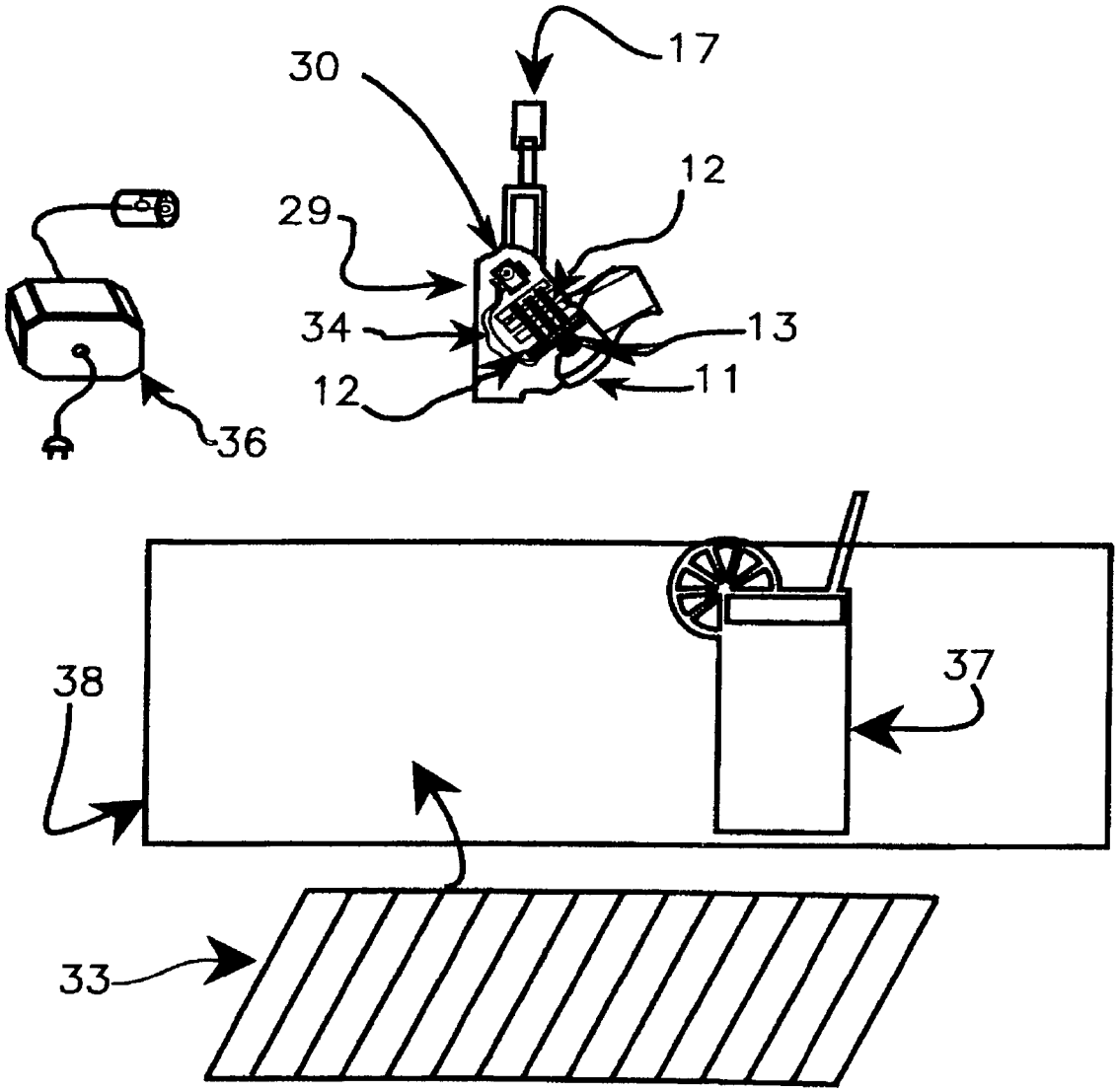
FIG. 2 is a cut away view of the illumination device with attached electrical connectivity and a UV sensitive colored plastic backsplash, drip tray, and an UVa sensitive comestible fluid container.

FIG. 2 shows a cut away view of portable illumination device 29 with light emitting diode 13 inserted into lens/collimator 11. Electrical conductors 34 are routed from LED 13 through heat sink 12 to miniature two pin female electrical connector 30. UVa sensitive backsplash area 38 is located below and behind portable illumination device 29 and a typical UVa sensitive comestible fluid container 37, with UVa sensitive liquid collecting drip tray 33 completes the illumination appartus description.

What is claimed is:

1. A four element portable fluid tap illumination system apparatus comprising:

a first portable element having a single light source illumination device, said first element consisting of a first side and a second side of a plastic injection molded case with snap fit connection means comprising locking pins and grooves, said first element having internal supports holding a light collimating lens and a PC board with a high intensity LED mounted thereon, said LED emitting both visible and ultraviolet light, a heat sink with air cooling means, a plastic injection molded bridge cap having a first surface that is concave and a second surface that is flat, two miniature electrical connection plugs mounted flush and into said first element within said first and second sides, said plugs electrically connected to each other and said LED, a power supply connected to one of said connection plugs providing power to said LED; a second element proximate the first portable element, said second element is a colored ultraviolet sensitive backsplash, a third element proximate said first and second elements, said third element being an ultraviolet light sensitive liquid receptacle or container, and or container holder; and a fourth element adjacent to said third element wherein said fourth element is a ultraviolet light sensitive drip tray.

* * * * *